US010351983B2

(12) United States Patent
Coombes

(10) Patent No.: US 10,351,983 B2
(45) Date of Patent: Jul. 16, 2019

(54) ADJUSTABLE CLAMPING SYSTEM FOR A SEWING MACHINE

(71) Applicant: Rex Ian Coombes, Brisbane (AU)

(72) Inventor: Rex Ian Coombes, Brisbane (AU)

( * ) Notice: Subject to any disclaimer, the term of this patent is extended or adjusted under 35 U.S.C. 154(b) by 125 days.

(21) Appl. No.: 15/538,053

(22) PCT Filed: Nov. 11, 2015

(86) PCT No.: PCT/AU2015/050697
§ 371 (c)(1),
(2) Date: Jun. 20, 2017

(87) PCT Pub. No.: WO2016/101019
PCT Pub. Date: Jun. 30, 2016

(65) Prior Publication Data

US 2017/0342619 A1 Nov. 30, 2017

(30) Foreign Application Priority Data

Dec. 23, 2014 (AU) ..... 2014905217

(51) Int. Cl.

| | |
|---|---|
| ***D05B 29/08*** | (2006.01) |
| ***D05B 29/00*** | (2006.01) |
| ***D05C 9/04*** | (2006.01) |
| ***D05B 55/00*** | (2006.01) |

(52) U.S. Cl.
CPC ..... *D05B 29/08* (2013.01); *D05B 29/00* (2013.01); *D05B 55/00* (2013.01); *D05C 9/04* (2013.01)

(58) Field of Classification Search
CPC ..... D05B 29/00; D05B 29/08; D05B 29/02; D05B 29/12; D05B 55/00; D05B 21/00; D05B 31/00; D05B 39/00; D05B 39/005; D05C 9/00; D05C 9/02; D05C 9/04
See application file for complete search history.

(56) References Cited

U.S. PATENT DOCUMENTS

| | | | | |
|---|---|---|---|---|
| 2,148,614 A * | 2/1939 | Gilardone | D05C 9/12 | 112/103 |
| 4,006,696 A * | 2/1977 | Robertson | D05B 11/00 | 112/117 |
| 4,534,303 A * | 8/1985 | Off | D05B 21/00 | 112/114 |
| 4,639,964 A * | 2/1987 | Binder | D05B 39/00 | 112/470.14 |
| 4,711,188 A * | 12/1987 | Yoneda | D05B 33/00 | 112/104 |
| 5,052,316 A * | 10/1991 | Sakakibara | D05B 39/00 | 112/10 |
| 5,094,179 A * | 3/1992 | Badillo | D05B 21/00 | 112/114 |

(Continued)

FOREIGN PATENT DOCUMENTS

JP 01175885 A * 7/1989

OTHER PUBLICATIONS

International Search Report dated Feb. 5, 2016, from International Application No. PCT/AU2015/050697, 3 pages.

*Primary Examiner* — Ismael Izaguirre
(74) *Attorney, Agent, or Firm* — Meunier Carlin & Curfman LLC

(57) ABSTRACT

The present disclosure generally relates to a clamping system. Particularly, the present disclosure relates to a clamping system for holding material to be sewn/embroidered by a sewing machine.

14 Claims, 14 Drawing Sheets

(56) References Cited

U.S. PATENT DOCUMENTS

| | | | | |
|---|---|---|---|---|
| 5,211,320 | A * | 5/1993 | Hubele | D05B 35/04 112/147 |
| 5,218,915 | A * | 6/1993 | Iwasaki | D05B 39/00 112/114 |
| 6,354,234 | B2 * | 3/2002 | Wakasugi | D05B 39/00 112/103 |
| 6,382,116 | B2 * | 5/2002 | Wakasugi | D05C 9/04 112/103 |
| 7,377,222 | B1 | 5/2008 | Moore | |
| 2011/0315059 | A1 | 12/2011 | Lee et al. | |

* cited by examiner

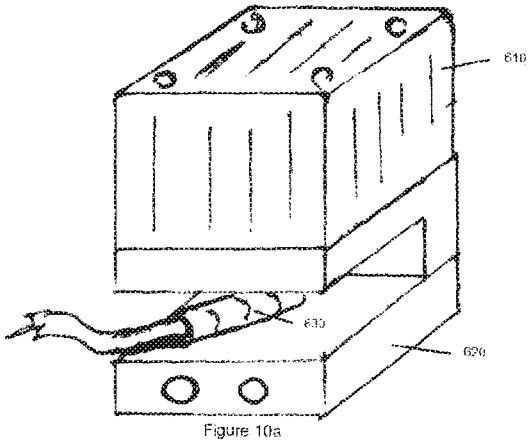
Figure 10a
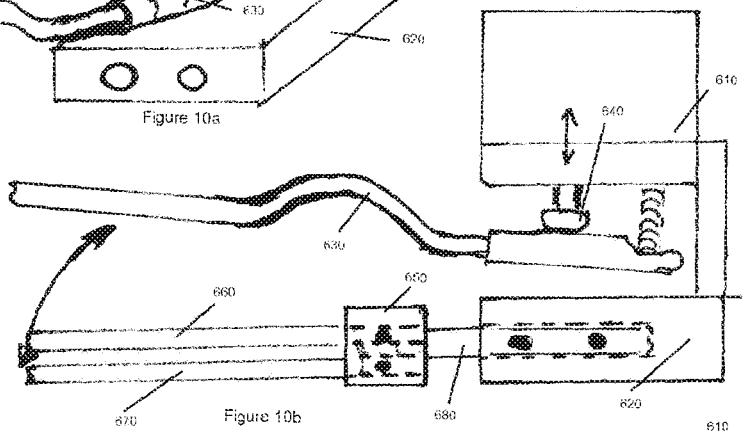
Figure 10b
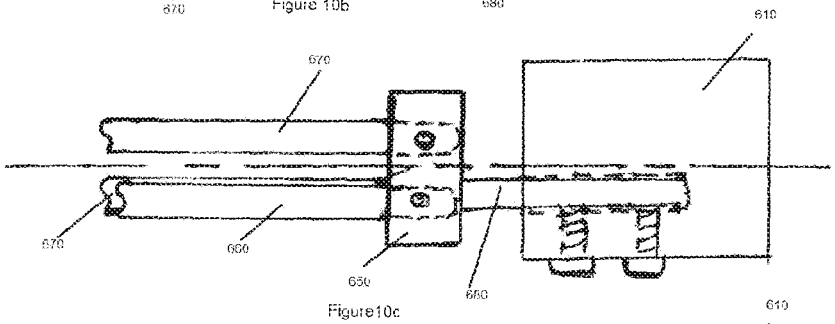
Figure10c
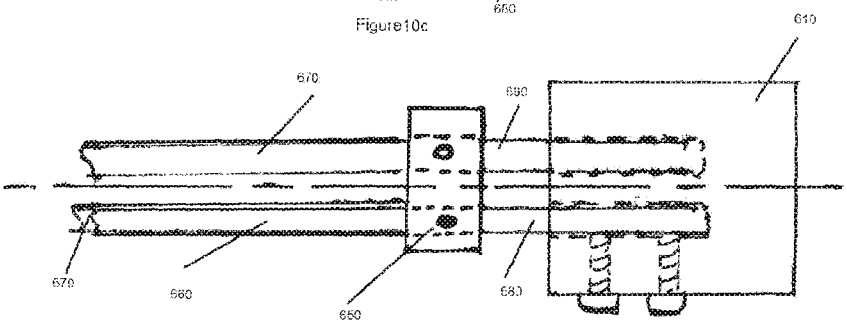
Figure 10d
Figure 10

ADJUSTABLE CLAMPING SYSTEM FOR A SEWING MACHINE

FIELD

The present disclosure generally relates to a clamping system. Particularly, the present disclosure relates to a clamping system for holding material to be sewn/embroidered by a sewing machine.

BACKGROUND

The conventional clamping system for holding material to be sewn/embroidered by a sewing machine includes a pair of tubular frame arms that are urged against a hoop frame in which the material to be sewn/embroidered by a sewing machine is already clamped. The hoop frame may be a standard hoop frame that has tubular, oblong or square hoop configuration. The pair of tubular frame arms hold the hoop frame in a desired aligned configuration such that the material to be sewn/embroidered that is clamped in the hoop frame is disposed over the needle plate so as to facilitate interaction between the needle of the sewing machine and the material to be sewn/embroidered to achieve the desired sewing/embroidery pattern. Such configuration of the conventional clamping system involves numerous cumbersome operations that require frequent human interventions and constant attention, more specifically, once sewing/embroidery is performed at a portion of the material that is clamped in the hoop frame, the hoop frame is withdrawn from the tubular frame arms to release the hoop frame, the portion of the material clamped in the hoop frame and on which sewing/embroidery is already performed is removed from the hoop frame and the hoop frame is applied to another portion of the material, or another piece of material on which sewing/embroidery pattern is to be performed. Thereafter, the hoop frame with another portion of the material on which sewing/embroidery pattern is to be performed is reinserted in the tubular frame arms therein and is again held by the tubular frame arms, such that the material to be sewn/embroidered that is clamped in the hoop frame is disposed over the needle plate so as to facilitate interaction between the needle of the sewing machine and the material to be sewn/embroidered to achieve the desired sewing/embroidery pattern on the material. Few prior art documents disclose clamping systems for holding an item or material to be embroidered.

For example, U.S. Pat. No. 8,584,606 discloses a hooping device. The hooping device is used with an embroidery machine to hold an item or material to be embroidered between upper and lower hooping members, with the hooping members being secured to one another by use of magnetic force is disclosed. The magnets provide a mating arrangement between the upper and lower hooping members. The hooping device also includes a retaining mechanism.

The conventional clamping system for holding material to be sewn/embroidered by a sewing machine has several disadvantages associated therewith. More specifically, in case of the conventional clamping systems machine downtime is unavoidable due to need for frame arm changeovers.

The conventional clamping systems require frequent re-hooping or re-looping of the material. Furthermore, the conventional clamping system requires frequent human intervention and constant attention. Further, the conventional clamping system fails to efficiently handle slippery or difficult to handle material. Further, the conventional clamping system may apply undue pressure on the material to be sewn/embroidered, thereby causing damage to the material. Further, the conventional clamping system fails to align and securely hold the material to be sewn/embroidered by a sewing machine in a controlled state as the conventional clamping system fails to adjust according to different widths of the material to be sewn. Further, the conventional clamping system fails to handle different widths of material to be sewn and fails to achieve different embroidery/sewing functions. Furthermore the conventional clamping system is not height adjustable to control the material to be sewn/embroidered at the needle point/needle plate. Further, the conventional clamping system has complex construction and is inconvenient to use.

Accordingly, there is a need for a clamping system for holding material to be sewn/embroidered by a sewing machine that eliminates the drawbacks of the conventional clamping system. More specifically, there is a need for a clamping system for holding material to be sewn/embroidered by a sewing machine that is capable of handling different widths of material to be sewn without the need of framing up the material. There is a need for a clamping system that aligns and securely holds the material to be sewn/embroidered by a sewing machine in a controlled state, thereby allowing for quick change/spacing relocation of at least one clamping arm to cater to different widths of material to be sewn/embroidered or achieving different embroidery/sewing functions. Further, there is a need for a clamping system that can handle a wide range of width of the material to be sewn/embroidered and that is simple in construction and convenient to use. Further, there is a need for a clamping system that eliminates frame arm changeovers, thereby reducing machine downtime that is unavoidable in conventional clamping systems. Further, there is a need for a clamping system that enhances productivity and reduces damage to material due to undue forces acting thereon during conventional framing, embroidery/sewing operation. Still further, there is a need for a clamping system that handles slippery or difficult to handle material to be sewn/embroidered.

OBJECTS

Some of the objects of the present disclosure, which at least one embodiment herein satisfies are as follows:

It is an object of the present disclosure to ameliorate one or more problems of the prior art or to at least provide a useful alternative.

An object of the present disclosure is to provide a clamping system for holding material to be sewn/embroidered by a sewing machine that is capable of handling different widths of material to be sewn.

Another object of the present disclosure is to provide a clamping system to align and securely hold material to be sewn/embroidered by a sewing machine in a controlled state allowing for quick change/spacing relocation of at least one clamping arm to cater to different widths of material to be sewn/embroidered or for achieving different embroidery/sewing functions.

Yet another object of the present disclosure is to provide a clamping system for holding material to be sewn/embroidered by a sewing machine that is adjustable according to different widths of material to be sewn and can handle wide range of width of material.

Another object of the present disclosure is to provide a clamping system for holding material to be sewn/embroidered by a sewing machine that is height adjustable to control material to be sewn/embroidered at the needle point/needle plate.

Still another object of the present disclosure is to provide a clamping system for holding material to be sewn/embroidered by a sewing machine that is capable of clamping/holding different configurations of frames supporting the material to be sewn.

Yet another object of the present disclosure is to provide a clamping system for holding material to be sewn/embroidered by a sewing machine that is simple in construction and convenient to use.

Still another object of the present disclosure is to provide a clamping system for holding material to be sewn/embroidered by a sewing machine that reduces machine downtime that is unavoidable in conventional clamping systems due to frame arm changeovers.

Yet another object of the present disclosure is to provide a clamping system that achieves clamping of slippery or difficult to handle material to be sewn/embroidered without exerting undue pressure on the material, thereby ensuring damage free handling of the material.

Another object of the present disclosure is to provide a clamping system for holding material to be sewn/embroidered by a sewing machine that eliminates the need to frequently re-hoop or re-loop the material to be sewn and facilitates wider sewing/embroidery patterns without the need to hoop up.

Still another object of the present disclosure is to provide a clamping system for holding material to be sewn/embroidered by a sewing machine that can be easily retro-fitted to almost any conventional commercial embroidery sewing machine setup.

Another object of the present disclosure is to provide a clamping system for holding material to be sewn/embroidered by a sewing machine that securely clamps material to be sewn without leaving any scope or chances of material damage due to undesirable movements during operation of the sewing machine.

Yet another object of the present disclosure is to provide a clamping system for holding material to be sewn/embroidered by a sewing machine that reduces frequent human intervention and constant attention.

Other objects and advantages of the present disclosure will be more apparent from the following description when read in conjunction with the accompanying figure, which are not intended to limit the scope of the present disclosure.

SUMMARY OF INVENTION

The present invention provides a clamping system for holding material to be sewn or embroidered without the need to pre clamp the work comprising:

(i) a plurality of clamping assemblies;
(ii) a base mounting plate for each of the assemblies;
(iii) a base track for positioning the clamping assemblies base mounting plates onto;
(iv) an air ram for each of the clamping assemblies;
(v) a sewing arm; and
(vi) a central over arm air ram/cylinder assembly configured with a forked guiding element.

Preferably, the system further comprises an upper operative arm and lower fixed arms.

Preferably, the system comprises at least 3 to 9 clamping assemblies.

Preferably, the system further comprises a triangulated lower clamping arm set, offset dual arms are positioned horizontally either side of the center line of the clamping assemblies and a third arm is positioned vertically above and also slightly offset above the outer of the horizontally paired dual lower arm set.

Preferably, the system further comprises a single or dual rod(s), and a lower base plate as part of an Air Rams assembly wherein the height of the lower base plate and rod/s is positioned at an alternative height to enable the lower triangulated (dual) rods extending out of a connector, to hold the material at the same height as a needle plate.

In another aspect, the present invention provides a clamping system for holding material to be sewn or embroidered comprising:

(i) a plurality of clamping assemblies;
(ii) a base mounting plate;
(iii) a base track;
(iv) an air ram for each of the clamping assemblies;
(v) a sewing arm; and
(vi) an upper air cylinder assembly triangulated with the lower air ram assemblies.

Preferably, the system further comprises a floating foot member attached to the upper air cylinder assembly.

Preferably, the air cylinder is located beneath an upper head of the system and is centred directly along the centre line of a sewing arm.

Preferably, the end of the air cylinder shaft is attached to and at the back of the floating foot.

Preferably, the system further comprises an X/Y-axis transporter bar and a channelled track to allow interchanging operation between:

i) triangulated lower clamping arm assemblies;
ii) tubular frame arm assemblies; and
iii) cap frame driver assembly.

Preferably, the channelled track is replaced with a dedicated linear track fixed onto the x/y axis transporter, with two linear bearing blocks which are easily positioned along the linear track and are adjustable by sprung locator pins.

Preferably, the linear blocks allow for quick change of dedicated lower clamping block modules, including:

i) triangulated lower clamping linear block module; and
ii) tubular frame arm linear block module.

BRIEF DESCRIPTION OF ACCOMPANYING DRAWING

The clamping system for holding material to be sewn in a sewing machine of the present disclosure will now be described in relation to the accompanying drawing, in which:

FIG. 1*a* illustrates a plan view of a three air ram/cylinder clamping system for holding material to be sewn/embroidered in accordance with an embodiment of the present disclosure, wherein a third clamping arm is disposed between two outer clamping arms and an air ram arrangement is used for actuating relative movement between clamping arms of the clamping system with a spring return arrangement fitted to the air rams to reopen the arms apart when disengaged (spring arrangement);

FIG. 1*b* illustrates a side elevation view of the three air ram clamping system of FIG. 1*a;*

FIG. 1*c* illustrates a plan view of a clamping system for holding material to be sewn/embroidered in accordance with another embodiment of the present disclosure, wherein the upper and lower clamping arms are shaped tubular type upper and lower frame adaptor clamping arms;

FIG. 2*a* illustrates another plan view of the three air ram clamping system illustrated in FIG. 1*a;*

FIG. 2*b* illustrates a side view of a clamping arm of the clamping system illustrated in FIG. 1*a;*

Figure 7A:
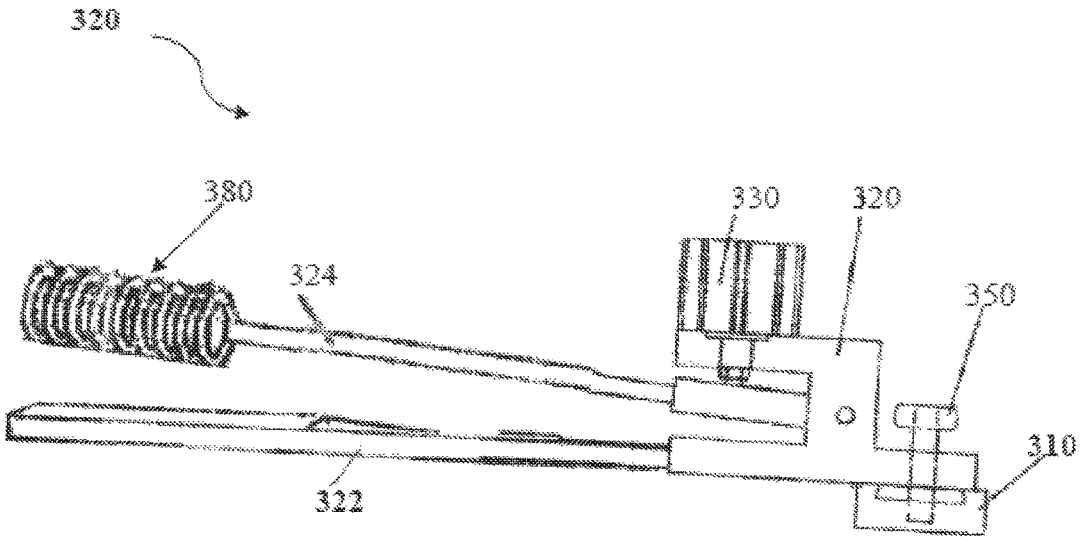
Figure 7B:
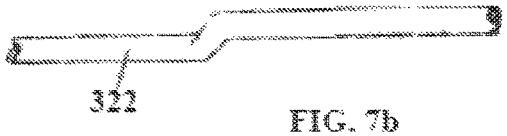
Figure 8:
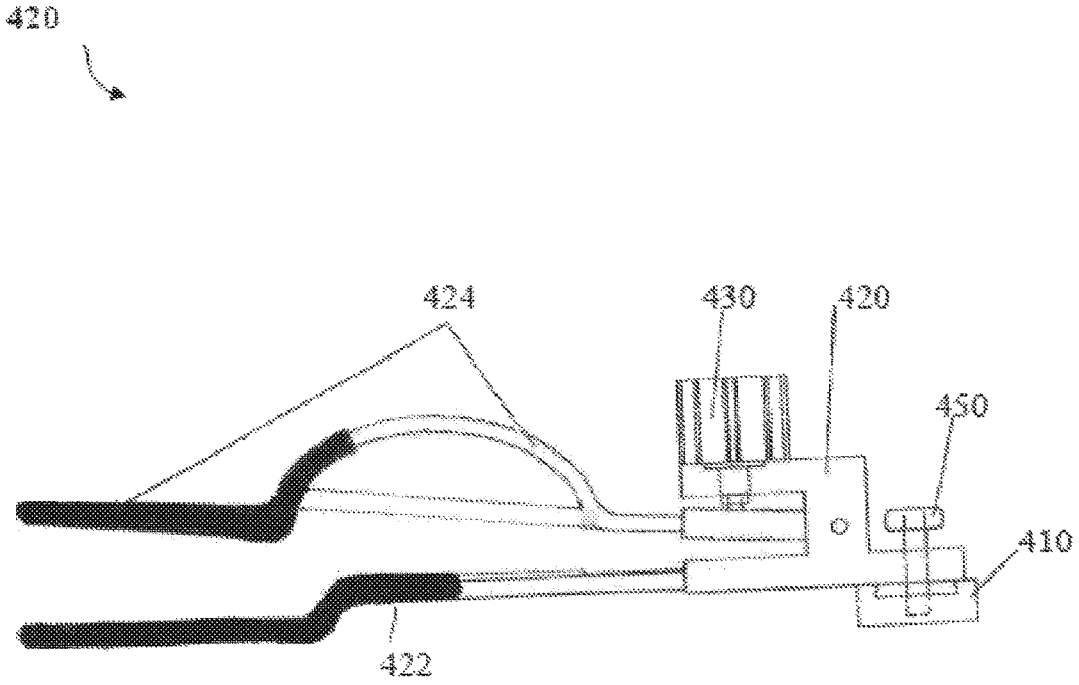
Figure 9:
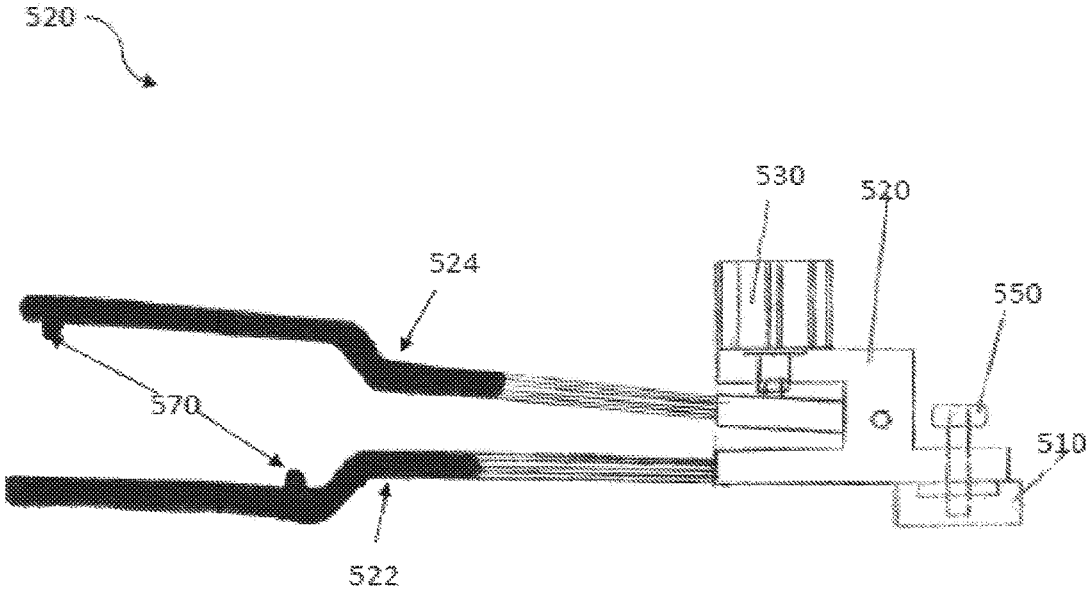

FIG. 7*a* illustrates a side elevation view of clamping arms of a clamping assembly of a system, wherein a spring coil arrangement is disposed as the movable curved (not shown) upper clamping arm with a flat type lower clamping arm;

FIG. 7*b* illustrates a schematic representation of a lower clamping arm in accordance with an embodiment of the present disclosure;

FIG. 8 illustrates a side elevation view of movable curved upper clamping arm and flat type lower clamping arm of the clamping system without the spring element disposed there between; and FIG. 9 illustrates a side elevation view of movable flat type upper clamping arm and flat type lower clamping arm of the clamping system without the spring element disposed there between in accordance with another embodiment of the present disclosure.

FIG. 10 illustrates the triangulated lower clamping arms system as an embodiment of the present invention.

Figure 11:
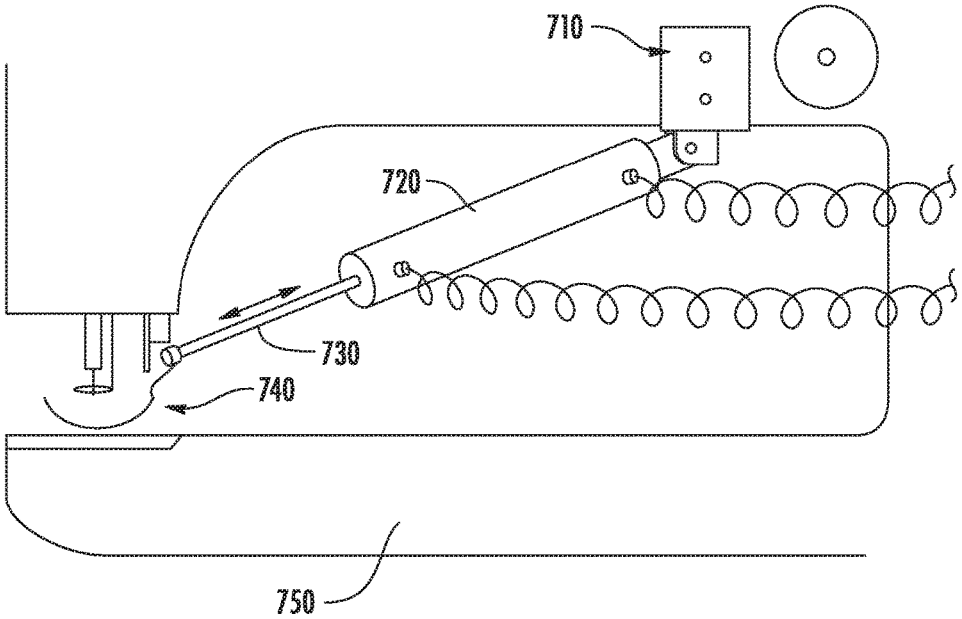
Figure 12:
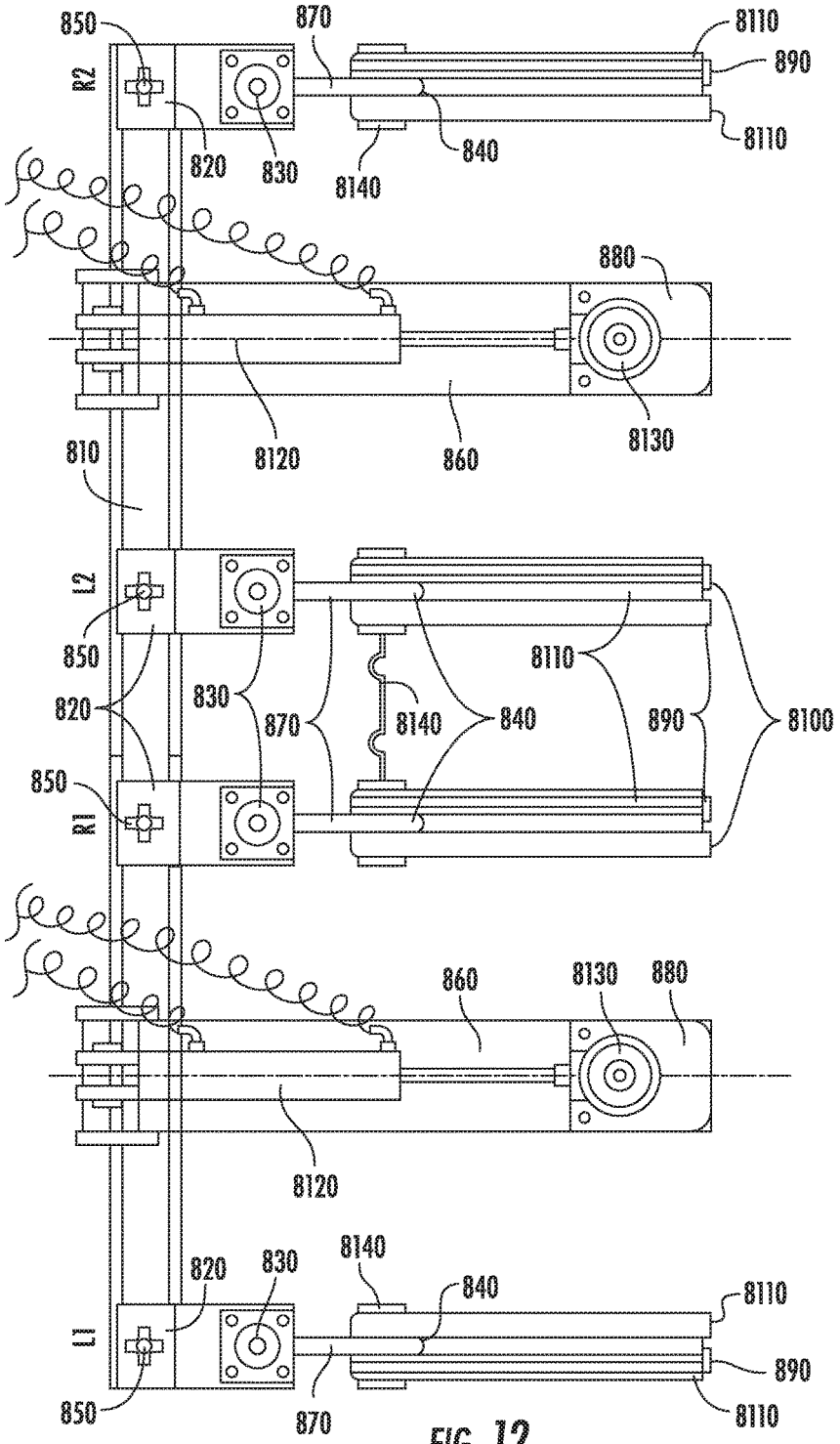

FIGS. 11 and 12 illustrate the triangulated upper air cylinder with floating foot as an embodiment of the present invention.

Figure 13:
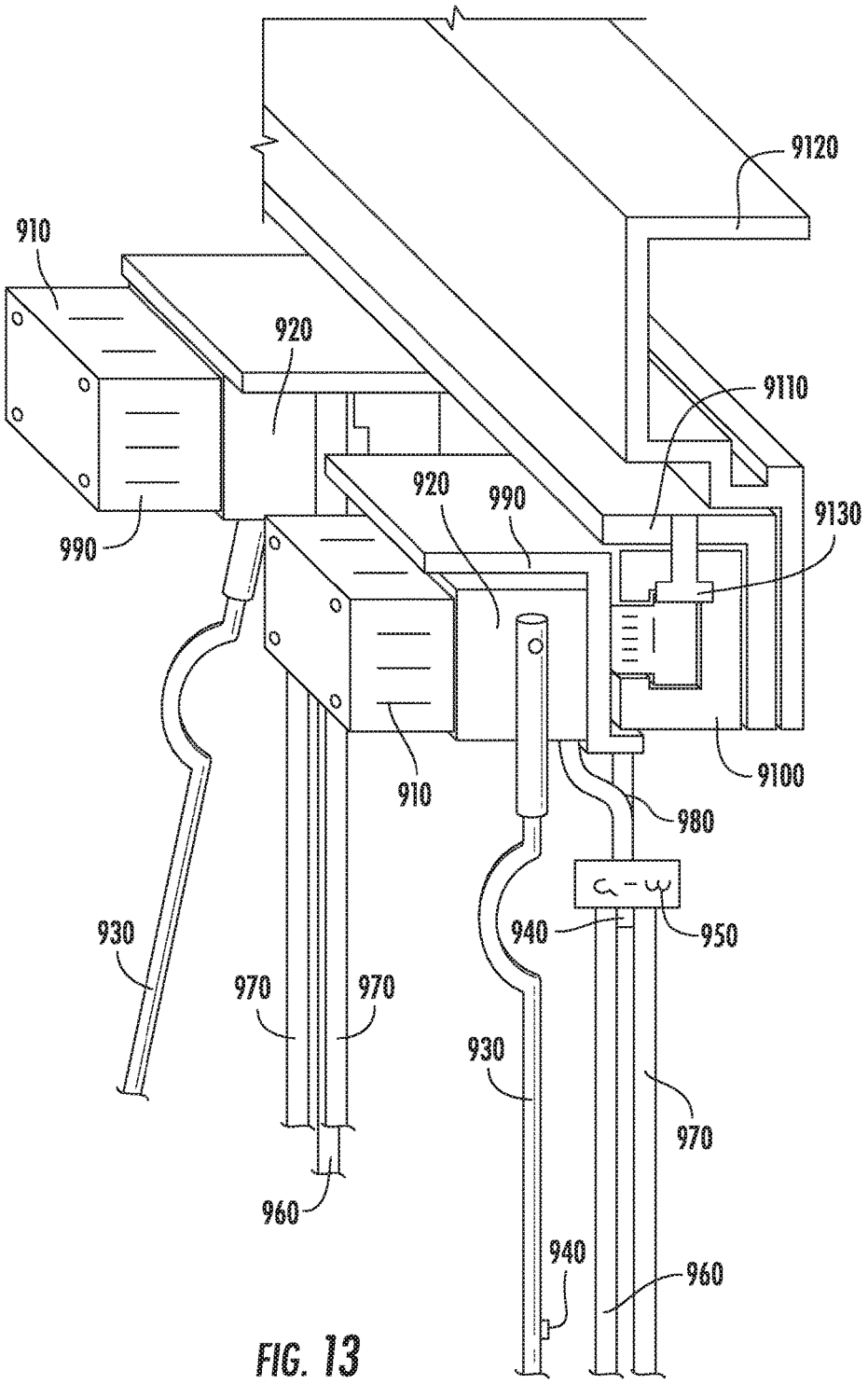

FIG. 13 illustrates the X-Y axis linear drive block assembly as an embodiment of the present invention.

DETAILED DESCRIPTION

A clamping system for holding material to be sewn/embroidered by a sewing machine will now be described with reference to the embodiments, which do not limit the scope and ambit of the disclosure. The description provided is purely by way of example and illustration. The embodiment herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The present disclosure envisages a clamping system for holding material to be sewn/embroidered that securely clamps material to be sewn in an aligned matter without causing any damage to the material. The clamping arm components of the clamping system are positioned onto their own individual multi position base plates which allow the relocation of the clamping arms along a channeled base mounting plate, by the release of one x screw. The channeled base mounting plates have multiple relocation screw points for positioning the clamping arm base plates along the channeled base mounting plates at between 10 mm and 20 mm spacing, such configuration of the clamping system allows for quick change/spacing relocation of at least one clamping arm on its own base plate to cater to different widths of material to be sewn/embroidered or for achieving different embroidery/sewing functions. The clamping system for holding material to be sewn/embroidered by a sewing machine is height adjustable to control material to be sewn/embroidered at the needle point/needle plate. The clamping system achieves clamping of slippery or difficult to handle material to be sewn/embroidered without exerting undue pressure on the material. Further, the clamping system eliminates the conventional frame arm changeovers, thereby reducing machine downtime that is unavoidable in case of conventional clamping systems.

Furthermore, the present invention:

1) provides a triangulated clamping system
2) does not require Pre-embroidery framing before clamping (no frame clamping
3) performs the clamping method by pneumatic operation; and
4) supports both single head and multi head assemblies.

Figure 1A:
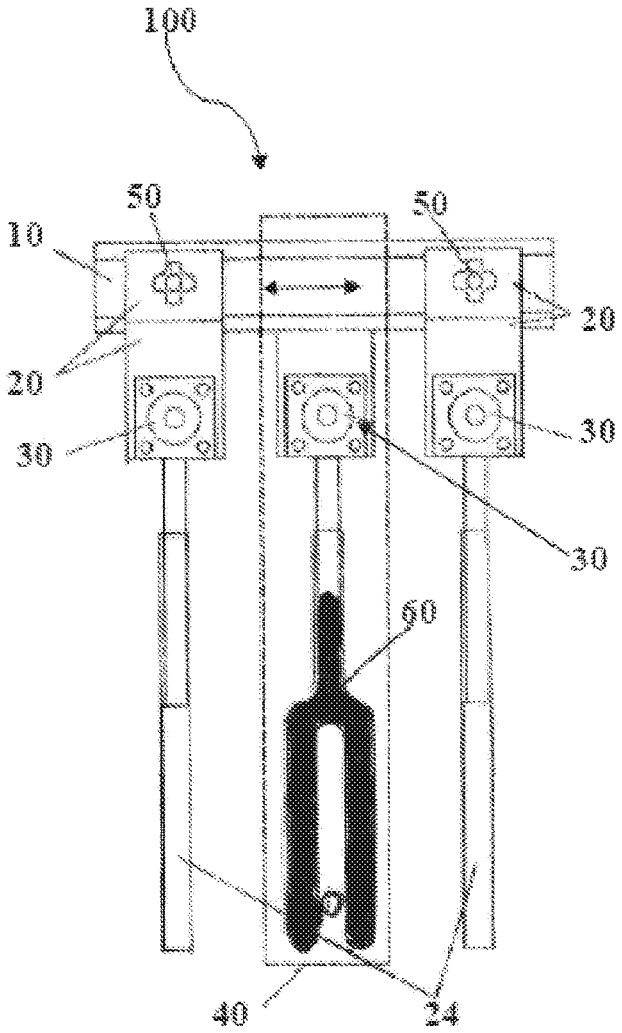
Figure 1B:
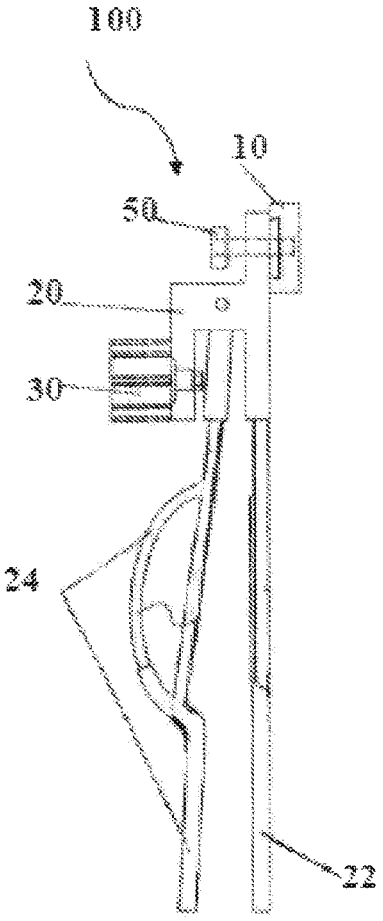
Figure 1C:
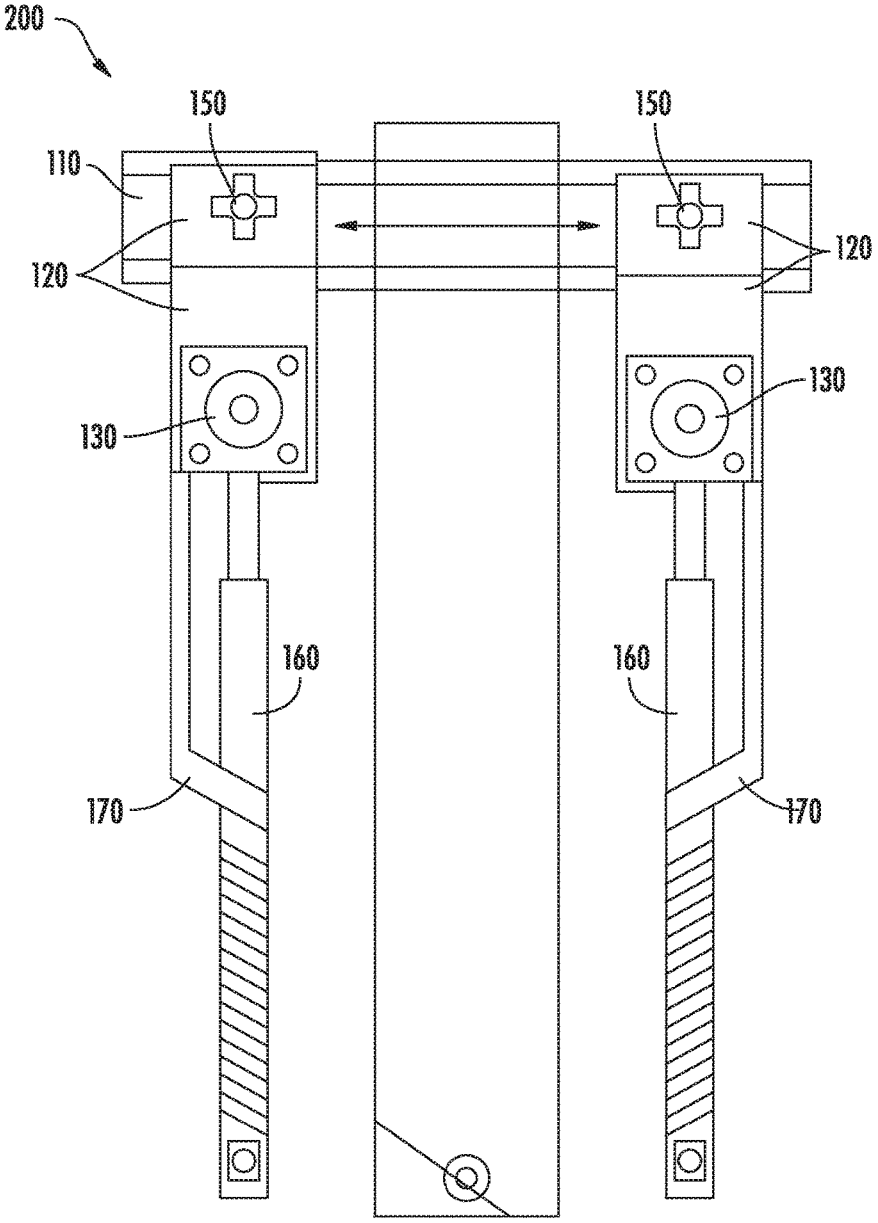

Referring to FIGS. 1*a* and 1*b*, the clamping system 100 for holding material to be sewn/embroidered includes a channeled base mounting plate 10, a plurality of clamping assemblies 20, an air ram 30 for each of the clamping assembly 20 and a sewing arm 40 and a central over arm 60 configured with a forked guiding element. Each clamping assembly 20 includes an operative lower clamping arm 22 that has a flat configuration and an operative upper clamping arm 24 that may have a flat configuration or spring configuration or curved configuration. Further, each of the clamping arms of the clamping assembly 20 may include a plurality of telescopic elements to permit axial adjustment of the clamping arms of clamping assembly 20. Each clamping assembly 20 further includes a spring arrangement disposed between the operative lower clamping arm 22 and the operative upper clamping arm 24 for urging the operative lower clamping arm 22 and the operative upper clamping arm 24 apart from each other when disengaged. The air ram 30 further applies urging forces for urging the operative lower clamping arm 22 and the operative upper clamping arm 24 towards each other. Further, the operative lower clamping arm 22 and the operative upper clamping arm 24 can be of different configuration, for example, the operative lower and upper arms can be shaped tubular type upper and lower frame adaptor clamping arms. Referring to FIG. 1*c*, a plan view of a clamping system for holding material to be sewn/embroidered in accordance with another embodiment of the present disclosure is illustrated, wherein the upper and lower clamping arms are shaped tubular type upper and lower frame adaptor clamping arms 170 and 160 respectively. The operative upper clamping arm 170 is movable with respect to the operative lower clamping arm 160 for gripping either the raw material or a hoop frame with material to be embroidered/sewn. The clamping assemblies 120 can be moved along the length of the channeled base mounting plate 110, particularly, a first end of each of the clamping assembly 120 is slide able with respect to the channeled base mounting plate 110 and can be fastened to the channeled base mounting plate 110 by using a quick change fastening arrangement such as a thumb screw/Allen key arrangement 150 or Spring loaded locator Pin. With such a configuration of the clamping system, the clamping arms provide quick hold/clamp and quick release of either the material or the pre hooped material frame to be embroidered/sewn. The plurality of clamping arms of the clamping system, clamps the material to be sewn/embroidered at multiple different points thereby creating multiple embroidery/sewing sites where embroidery/sewing can be performed. The head of the sewing machine is in a fixed position and the material to be sewn/embroidered is positioned operatively above any of the embroidery/sewing sites disposed over the needle plate so as to facilitate interaction between the needle of the sewing machine and the material to be sewn/embroidered at the desired embroidery/sewing sites to achieve the desired sewing/embroidery pattern. Accordingly, there is no need to manually lift the clamping arms to release the hoop frame, changing position of the hoop frame, removing the portion of the material clamped in the hoop frame and on which the sewing/embroidery is already performed and applying the hoop frame to another portion of the material on which sewing/embroidery pattern is to be performed.

Accordingly, such configuration of the clamping system 100 eliminates frame arm changeovers, thereby reducing machine downtime that is unavoidable in conventional clamping systems. Further, with such configuration of the clamping system 100, the clamping system 100 adjusts according to different widths of the material to be sewn and the holding of different widths of the material to be sewn/embroidered by a sewing machine is now possible that was not feasible in case of the conventional clamping system.

Figure 2A:
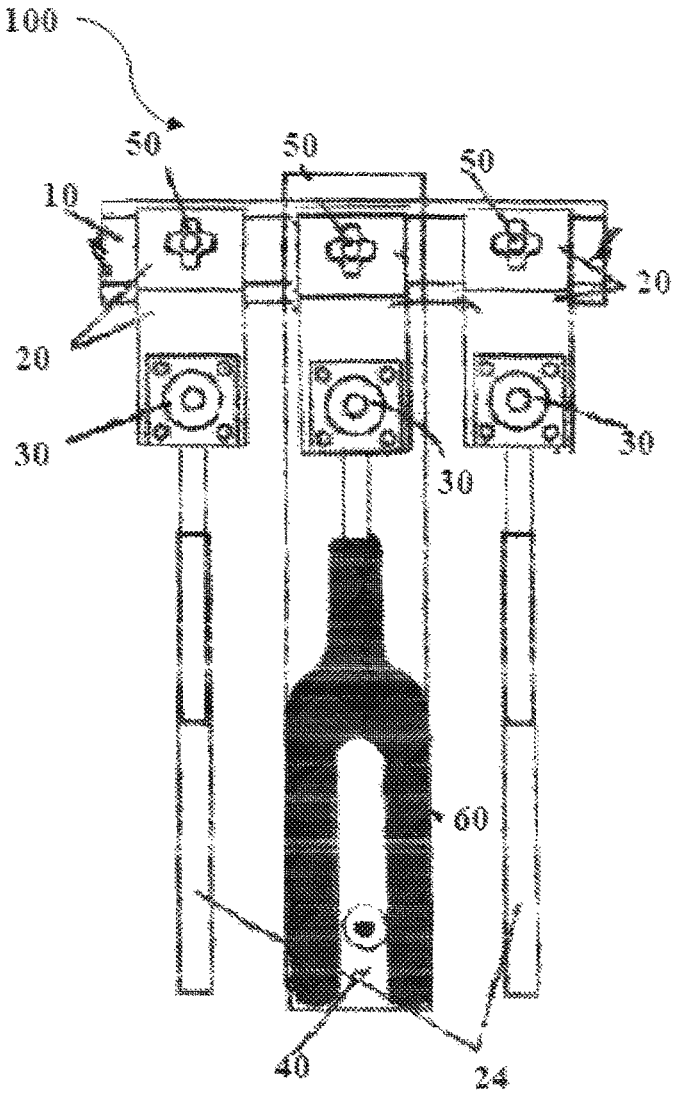

FIG. 2*a* illustrates another plan view of the three air ram clamping system 100.

Figure 2B:
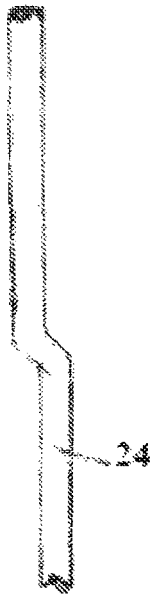

FIG. 2*b* illustrates a side view of a clamping arm of the clamping system 100.

Figure 3:
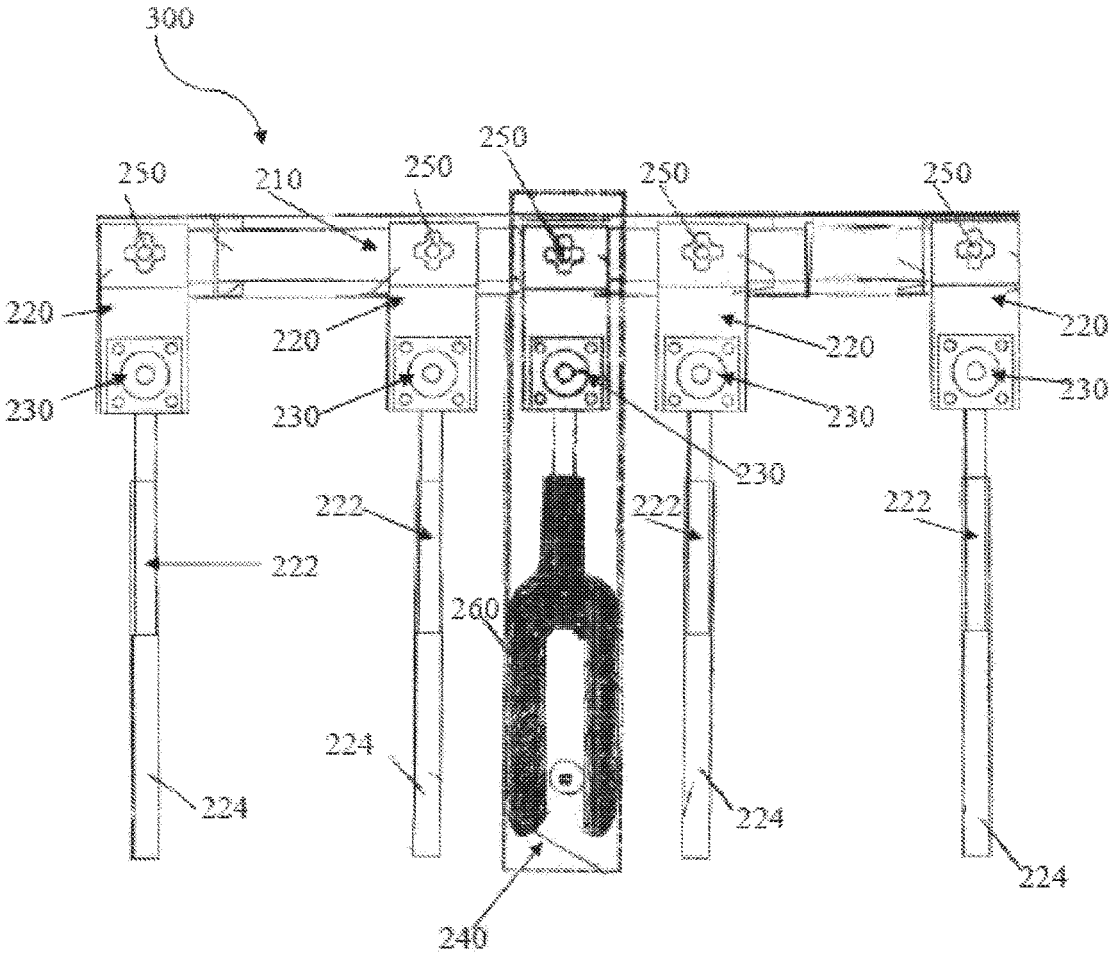
FIG. 3 illustrates a plan view of a five air ram clamping system in accordance with another embodiment of the present disclosure, wherein two clamping arms are disposed on both sides of a centrally disposed clamping arm.

Referring to FIG. 3, a plan view of a five air ram clamping system 300 in accordance with another embodiment of the present disclosure is illustrated, wherein two clamping assemblies 220 are disposed on both sides of a centrally disposed clamping arm. The five air ram clamping system 300 for holding material to be sewn/embroidered includes a channeled base mounting plate 210, a plurality of clamping assemblies 220, an air ram 230 for each of the clamping assembly 220 and a sewing arm 240 and a central over arm 260 configured with a forked guiding element. Each clamping assembly 220 includes an operative lower clamping arm 222 that has a flat configuration and an operative upper clamping arm 224 that may have a flat configuration or spring configuration or curved configuration. Further each of the clamping arms of the clamping assembly 220 may include a plurality of telescopic elements to permit axial adjustment of the clamping arms of clamping assembly 220. Each clamping assembly 220 further includes a spring arrangement disposed between the operative lower clamping arm 222 and the operative upper clamping arm 224 for urging the operative lower clamping arm 222 and the operative upper clamping arm 224 towards each other. The air ram 230 further applies urging forces for urging the operative lower clamping arm 222 and the operative upper clamping arm 224 towards each other. Further, the operative lower clamping arm 222 and the operative upper clamping arm 224 can be of different configuration, for example, the operative lower and upper arms can be shaped tubular type upper and lower frame adaptor clamping arms. The operative upper clamping arm 224 is movable with respect to the operative lower clamping arm 222 for gripping either a hoop frame or the material to be embroidered/sewn. The clamping assemblies 220 can be moved along the length of the channeled base mounting plate 210, particularly, a first end of each of the clamping assembly 220 is slide able with respect to the channeled base mounting plate 210 and can be fastened to the channeled base mounting plate 210 by using a quick change fastening arrangement such as a thumb screw/Allen key arrangement 250. Further, in case of the five air ram clamping system 300, the second and fifth clamping frame arms can be exchanged for edge clamping control, so that they are not in the path and do not interfere with the embroidery.

Figure 4:
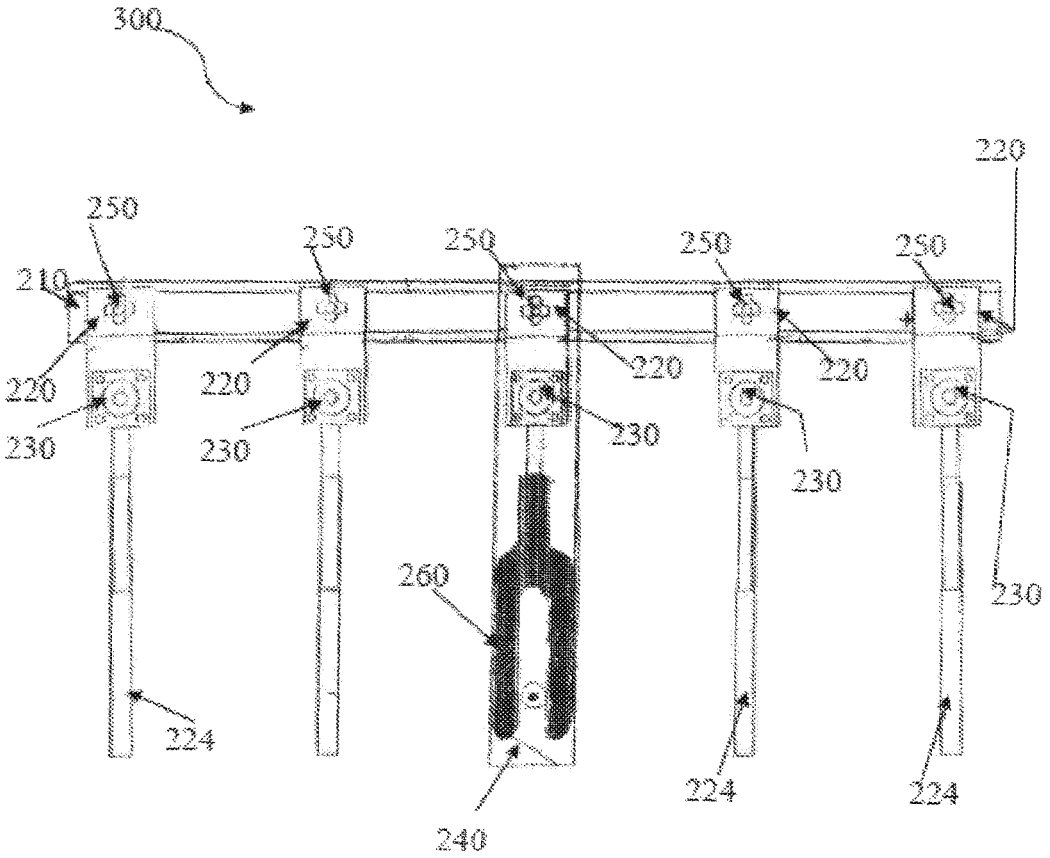
FIG. 4 illustrates a plan view of the five air ram clamping system in another configuration.
Figure 5:
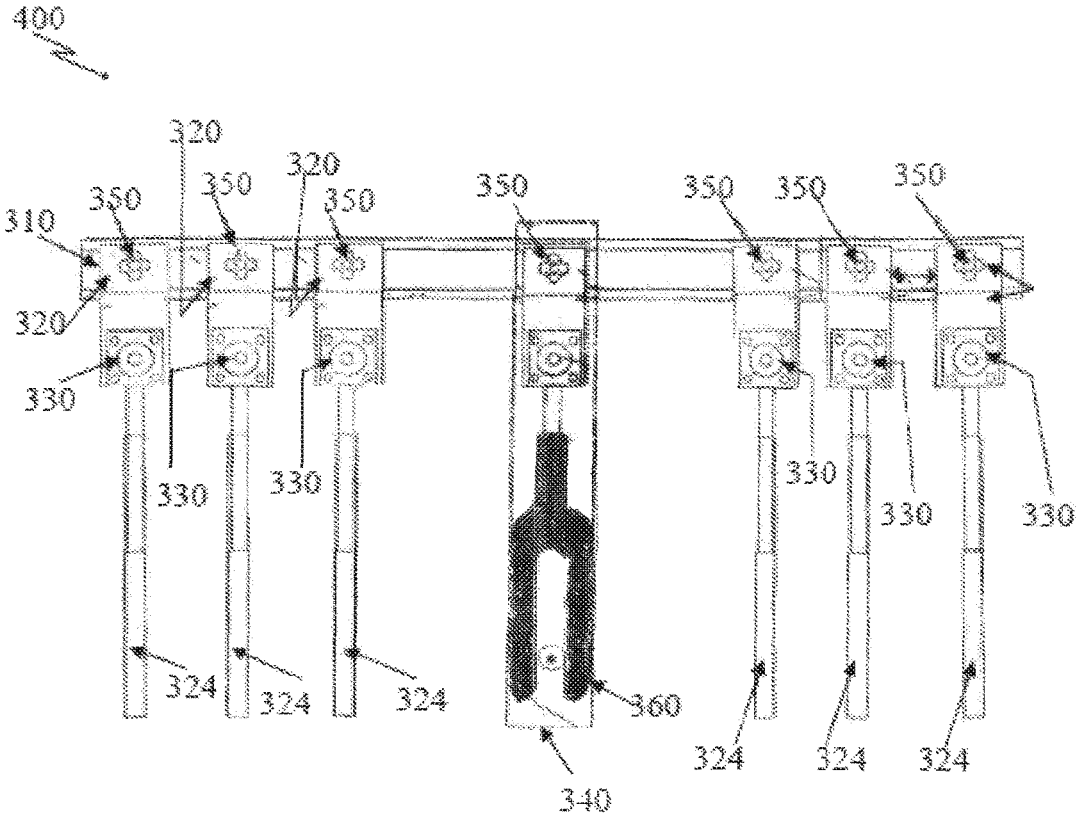
FIG. 5 illustrates a plan view of a seven air ram clamping system in accordance with still another embodiment of the present disclosure, wherein three clamping arms are disposed on both sides of a central clamping arm.

Referring to FIG. 5, a plan view seven air ram clamping system 400 is illustrated in accordance with another embodiment of the present disclosure, wherein three clamping arms 324 are disposed on both sides of a central clamping arm. The seven air ram clamping system 400 further includes a sewing arm 340 and a central over arm 360 configured with a forked guiding element. The clamping assemblies 320 can be moved along the length of a channeled base mounting plate 310. The seven cylinder clamping system 400 is structurally and functionally similar to the five air ram clamping system 300 as illustrated in FIG. 4, wherein the only difference is that instead of two clamping arms 224 disposed on both sides of central clamping arm as in case of clamping system 300 there are three clamping arms 324 disposed on both sides of central clamping arm in case of the clamping system 400 and for the sake of brevity of the present document, the seven air ram clamping system 400 is not described in details.

Figure 6:
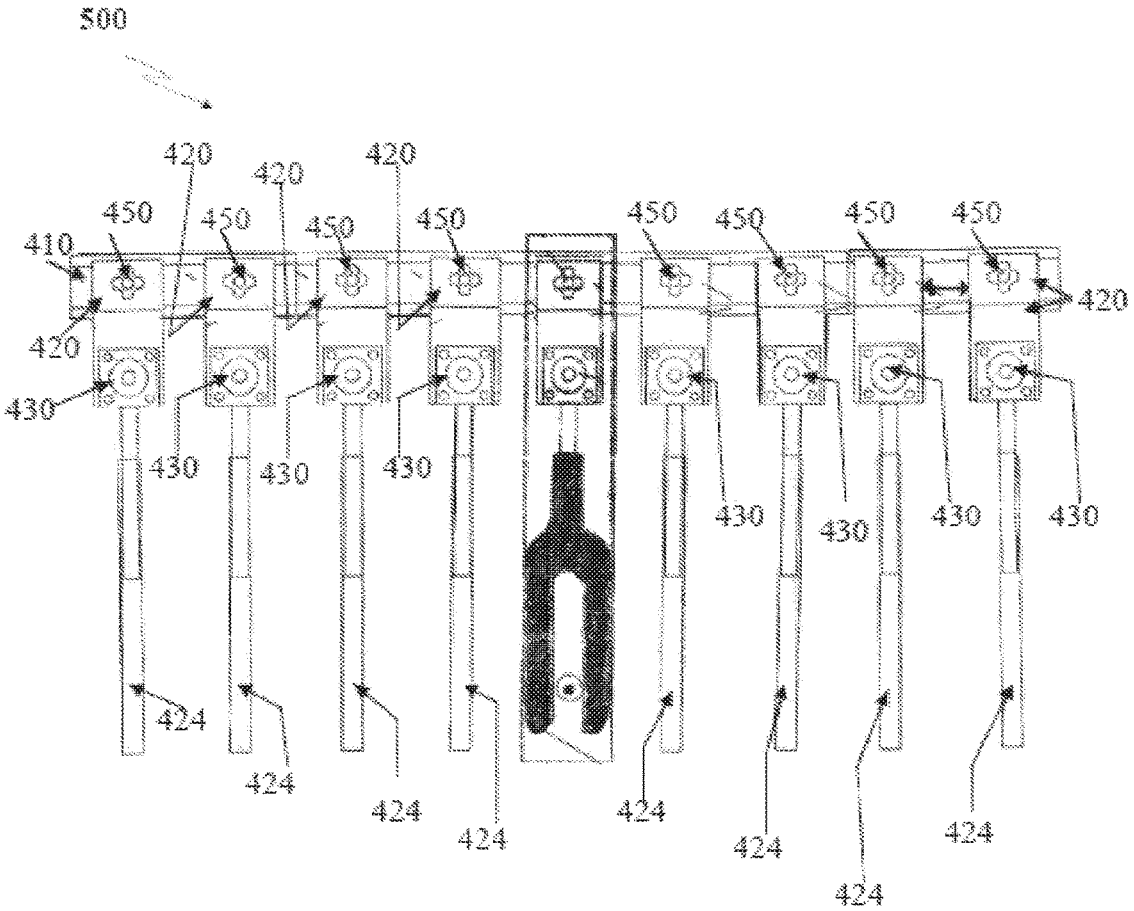
FIG. 6 illustrates a plan view of a nine air ram clamping system in accordance with still another embodiment of the present disclosure, wherein four clamping arms are disposed on both sides of a central clamping arm.

Referring to FIG. 6, a plan view nine air ram clamping system 500 is illustrated in accordance with another embodiment of the present disclosure, wherein four clamping arms 424 are disposed on both sides of a central clamping arm and for the sake of brevity of the present document, the nine air ram clamping system 500 is not described in details. FIGS. 1*a*, 1*c*, 2*a*, 3, 4, 5 and 6 disclose a two-step, or multi step, air damping embodiment of the clamping system which enables an operator to load one side of the multi clamp configuration prior to loading the other side to maintain extra control of the material being clamped.

FIG. 7*a* illustrates a side elevation view of a pair of clamping arms 324 and 322 of a clamping assembly 320 of a clamping system, wherein a spring arrangement 380 is disposed at the clamping end of the clamping arm 324 and flat type lower clamping arm 322. The air ram 330 further applies urging forces for urging the operative upper clamping arm 324 and the operative lower clamping arm 322 towards each other. The clamping assemblies 320 can be moved along the length of a channeled base mounting plate 310, particularly, a first end of each of the clamping assembly 320 is slide able with respect to the channeled base mounting plate 310 and can be fastened to the channeled base mounting plate 310 by using a quick change fastening arrangement such as a thumb screw/Allen key arrangement 350. The clamping arm 324 and the clamping arm 322 can be of the flat type or of the curved type or spring type, depending upon the requirement or the demand. FIG. 7*b* illustrates a schematic representation of a lower clamping arm 322.

FIG. 8 illustrates a side elevation view of a pair of clamping arms 424 and 422 of a clamping assembly 420 of a clamping system, wherein a spring arrangement 480 (not illustrated in the FIG. 8) is disposed between the clamping arm 424 and flat type lower clamping arm 422 for urging the clamping arms 424 and 422 apart when clamps are in the "disengaged" or "Open for Loading State". The air ram 430 further applies urging forces for urging the operative upper clamping arm 424 and the operative lower clamping arm 422 towards each other. The clamping assemblies 420 can be moved along the length of a channeled base mounting plate 410, particularly, a first end of each of the clamping assembly 420 is slide able with respect to the channeled base mounting plate 410 and can be fastened to the channeled base mounting plate 410 by using a quick change fastening arrangement such as a thumb screw/Allen key arrangement 450.

FIG. 9 illustrates a side elevation view of a pair of clamping arms 524 and 522 of a clamping assembly 520 of a clamping system in accordance with another embodiment. The clamping assembly 520 is structurally and functionally similar to the clamping assembly 420, only difference being in the configuration of the clamping arms and for the sake of brevity of the present disclosure is not described in details. The clamping arms 524 and 522 are provided with protruding elements also referred to as raised lugs or location pins or location nipples 570, wherein the protruding elements face each other but can be spaced apart and have heights of about 2 mm. the minimum gap between the clamping arms 524 and 522 of the clamping assembly 520 is in the range of 5-9 mm preferably 7 mm, when in a closed configuration which accommodates the upper arm in full contact with and in between the lower dual arms. The raised lugs or location pins 570 enable multi-usage of the clamping system to accept tubular frames without the need to change back over to the conventional type frame arms. Such option minimizes down time and enables quick change to include conventional hoop usage with the clamping system.

Further, with such configuration of the clamping system, the tri-angulated upper air cylinder with floating foot allows accommodation of wider embroidery patterns which can now be sewn without the need of hooping in larger frames. For embroidering wider embroidery patterns, all that is required is one or both of the outer arms to be repositioned out along the base plates to achieve the perimeter/width required for the wider embroidery patterns.

FIG. 10 illustrates the triangulated lower clamping rods/arms system 600 as an embodiment of the present invention.

FIG. 10 shows a triangulated lower clamping arm set 660, offset dual rods/arms 670 positioned horizontally either side of the center line of the clamping assemblies and the triangulated rod/arm 660 is positioned vertically above and also slightly offset above the outer of the horizontally paired dual lower rod/arm set 670.

The system further comprises a single 680 rod or dual rods 690, and a lower base plate as part of an Air Rams assembly 610 wherein the height of the lower base plate and rod/s is positioned at an alternative height to enable the lower triangulated (dual) rods extending out of a connector 650, to hold the material at the same height as a needle plate.

This variation ensures the material in production is controlled at the height of the needle plate and that any vertical movement with the needle penetration or withdrawal is controlled (in conjunction with the floating foot) to minimise and/or prevent "flagging" of the material.

Furthermore, the single/dual rods extending from the lower base plate pass through the QUE quick change "PIE" connector 650 enabling the dual or tri rod arm configuration to be chosen without undue downtime.

The Dual arm options allows for:

(a) the Dual lower rods to extend through the connector 650 to maintain parallel positioning and rigidity;

(b) The Dual lower rods to be triangulated with a third rod held in the connector 650, positioned above and slightly offset over the outer of the lower Dual rods.

The Tri rod feature allows the usage of tubular or square frames to be positioned onto the top of the Tri rods for correct height positioning. It also enables the cap frame drive to be positioned onto the Dual rods, and sit inside the Tri rod, which acts as a location guide on the Triangulated Left and Right Arm assemblies.

Location nipples which are located at the heel and toe of the arms enable the positioning of the tubular frame and cap frames to maintain absolute registration.

The travelling or operative upper arm 630 of the Lower Triangulated Arm assembly is shaped to accommodate the PIE connector 650 and can be inserted to attain a horizontal (flat) curvature when clamping tubular brackets and cap frame driver arms or a vertical curvature when clamping various material without any conventional framings jigs (no frame clamping).

FIG. 11 illustrates the triangulated upper air cylinder with floating foot as an embodiment of the present invention.

FIGS. 11 and 12 show an upper air cylinder assembly triangulated with the lower air ram assemblies.

In FIG. 11, a floating foot member 740 is attached to the triangulated upper air cylinder assembly 720.

The air cylinder 720 is located beneath an upper head of the system and is centred directly along the centre line of a sewing arm 750.

The floating foot 740 is activated by a separate switch which is connected to the operation of the lower clamping arm foot controller, after the working material has been clamped.

When activated, the floating foot 740 is positioned over and above the needle plate of the machine.

The floating foot 740 floats above the material in process, without interfering with the material or the operational needle bar/presser foot of the machine.

The floating foot 740 can be an open towed, closed towed or saucer shaped foot. Each of these configurations has curved edges around the circumference of the foot.

The end of the air cylinder shaft 730 is attached to and at the back of the floating foot 740.

The floating foot 740 has a hole (not necessarily cylindrical in shape) through the centre of the foot, to allow clear passage of both the needle bar and pressure foot in operation, to pass through the centre of the floating foot.

When not activated, the floating foot 740 is retracted up behind (withdrawn back and is located up behind) the Thread catcher bar, clear of and above the working area and the lower clamping arms.

The Floating Foot is a further improvement on the central Air Ram with

Forked Toe which has been re-engineered to the Triangulated "Under head Upper Air Cylinder with Floating Foot"

The purpose of the Floating Foot is to "Hover" just above the surface of the material being embroidered, without interfering with the travel of the Needle Bar or Machine Presser Foot during the embroidery operation.

The Floating Foot, in effect replaces the function of the Tubular frame by keeping the fabric being embroidered, flat and above the needle plate surface area, thus minimizing any effect of Fabric Flagging with the entry and exit of the Needle wherein the fabric would "Cling" to the needle and move upwards with the Needle as the Needle was in its upwards stroke.

The Floating Foot becomes an additional Foot that sits just above the fabric, and under its own weight and thus prevents the fabric from riding upwards with the Needle.

The Floating Foot Does Not apply any pressure or drag on to the surface of the material being sewn.

FIG. 12 illustrates the triangulated upper air cylinder with floating foot as an embodiment of the present invention.

In this embodiment, the original central fixed arm air ram with Forked Toe, has been replaced with an air cylinder 8120 with Floating Foot 8130 which is now attached beneath the head of the sewing/embroidery machine.

This "Upper" air cylinder 8120 has been relocated from a fixed position on the X/Y Axis Drive Frame over the centre line axis of the Sewing arm 860 to a fixed position underneath the head of the sewing head and held into position by means of a fixed bracket attachment.

Referring to FIG. 12, a plan view of a multi head machine (example: 2 head) with multiple air rani/cylinder clamping system 800 (also referred to as "Q5" or "Q9") in accordance with another embodiment of the present disclosure is illustrated, wherein two clamping assemblies R1 and L2 are centrally disposed as part of the clamping system. The multiple air ram/cylinder clamping system 800 for holding material to be sewn/embroidered includes a channeled base mounting plate or track 810, a set of clamping assemblies on either side of assemblies R1 and L2, an air ram 830 for each of the clamping assemblies, a sewing arm 860 and a floating foot member 8130 attached to the upper air cylinder assembly 8120.

FIG. 13 illustrates the X-Y axis linear drive block assembly as an embodiment of the present invention.

FIG. 13 shows an X/Y-axis transporter 9120 and a channelled linear track 9100 to allow interchanging operation between the:

(a) triangulated lower clamping arm assemblies;
(b) tubular frame assemblies; and
(c) cap frame driver assembly.

The original channelled track is replaced with a dedicated linear track 9100 fixed onto the X/Y axis transporter 9120, with two linear bearing blocks 990 which are easily positioned along the linear track 9100 and are adjustable by sprung locator pins 9130.

The linear blocks 990 allow for quick change of dedicated lower clamping block modules, including (a) triangulated lower clamping linear block module; and
(b) Optional tubular frame arm linear block module Tubular.

Linear block 990 is a component. A block module is a group of components. A Linear block module is a module inclusive of components 910, 920, 930, 940, 950, 960, 970 & 990.

Technical Advancements

The clamping system for holding material to be sewn/embroidered by a sewing machine has several technical advantages including but not limited to the realization of:

- a clamping system for holding the material to be sewn/embroidered by a sewing machine that is capable of handling different widths of the material to be sewn without the need of pre framing up the work;
- a clamping system for holding the material to be sewn/embroidered by a sewing machine that is capable of handling different widths of the material to be sewn;
- a clamping system for holding material to be sewn/embroidered by a sewing machine that is adjustable according to different widths of the material to be sewn and can handle wide range of width of the material;
- a clamping system for holding material to be sewn/embroidered by a sewing machine that is height adjustable to control the material to be sewn/embroidered at the needle point/needle plate;
- a clamping system to align and securely hold the material to be sewn/embroidered by a sewing machine in a controlled state, thereby allowing for quick change/spacing relocation of at least one clamping arm to cater to different widths of the material to be sewn/embroidered or for achieving different embroidery/sewing functions;
- a clamping system for holding material to be sewn/embroidered by a sewing machine that is capable of clamping/holding different configurations of frames supporting the material to be sewn;
- a clamping system that achieves clamping of slippery or difficult material to be sewn/embroidered without exerting undue pressure on the material, thereby ensuring damage free handling of the material;
- a clamping system for holding the material to be sewn/embroidered by a sewing machine that reduces the machine downtime that is otherwise unavoidable in conventional clamping systems due to frame arm changeovers;
- a clamping system for holding the material to be sewn/embroidered by a sewing machine that is simple in construction and convenient to use;
- a clamping system for holding the material to be sewn/embroidered by a sewing machine that eliminates the need to frequently re-hoop or re-loop the material to be sewn and facilitates wider sewing/embroidery patterns;
- a clamping system for holding the material to be sewn/embroidered by a sewing machine that can be easily retro-fitted onto almost any conventional commercial embroidery/sewing machine setup;
- a clamping system for holding the material to be sewn/embroidered by a sewing machine that securely clamps the material to be sewn without leaving any scope or chances of the material damage due to undesirable (hoop failure) movements during operation of the sewing machine; and
- a clamping system for holding the material to be sewn/embroidered by a sewing machine that reduces frequent human intervention and constant attention.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Wherever a range of values is specified, a value up to 10% below and above the lowest and highest numerical value respectively, of the specified range, is included in the scope of the disclosure.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

LEGEND

FIG. 10
610 Air Ram
620 Air Ram Base
630 Travelling Upper (operative) Arm
640 Air Ram "Plunger"
650 Connector
660 Triangulated Lower TRI Clamping Arm
670 Lower Triangulated Offset DUAL arm/s
680 Lower Base Rod—Single
690 Lower Base Rod—Dual
FIG. 11
710 Upper Air Cylinder Mounting bracket
720 Triangulated "Upper" Air Cylinder
730 Air Cylinder Shaft
740 Forked/Floating Foot
750 Sewing Arm
FIG. 12
810 Track
820 Air Ram Base
830 AirRam
840 Tubular Frame Positioning Nipple
850 Locator Pin
860 Sewing Arm
870 Lower Air Ram Base Rod(s)
880 Needle Plate
890 Triangulated Lower Dual Arm (Outer)
8100 Triangulated Lower Dual Arm (Inner)
8110 Triangulated Lower TRI Arm
8120 Triangulated—Upper Air Cylinder
8130 Floating Foot
8140 Connector
FIG. 13
910 Air Ram
920 Air Ram Base
Travelling Upper
930 (operative) Arm
940 Tubular Frame Positioning Nipple
950 Connector
960 Triangulated Lower TRI Arm
970 Triangulated Lower Dual Arms
980 Lower Air Ram Base Rod (s)
990 Linear transporter Bearing Block
9100 Linear Track/Channeled Track
9110 L Plate Connector
9120 X/Y Axis transporter
9130 Locator Pin Note: The drawings are not drawn to scale.

The claims defining the invention are as follows:

1. A clamping system for holding material to be sewn or embroidered comprising:
(i) a plurality of clamping assemblies;
(ii) a base mounting plate for each of the assemblies;
(iii) a base track for positioning the clamping assemblies base mounting plates onto;
(iv) an air cylinder for each of the clamping assemblies;
(v) a sewing arm;
(vi) a central over arm air cylinder assembly configured with a forked guiding element; and
(vii) a triangulated lower clamping arm set, offset dual arms are positioned horizontally either side of the centre line of the clamping assemblies and a third arm is positioned vertically above and also slightly offset above the outer of the horizontally paired dual lower arm set.

2. The system according to claim 1 further comprising an upper operative arm and lower fixed arms.

3. The system according to claim 1 comprising at least 3 to 9 clamping assemblies.

4. The system according to claim 3 wherein the central over arm air cylinder assembly is configured with a floating foot member.

5. The system according to claim 4 further comprising a single or dual rod(s), and a lower base plate as part of an Air cylinder assembly wherein the height of the lower base plate and rod/s is positioned at an alternative height to enable the lower triangulated (dual) rods extending out of a connector, to hold the material at the same height as a needle plate.

6. A clamping system for holding material to be sewn or embroidered comprising:
(i) a plurality of clamping assemblies;
(ii) a base mounting plate;
(iii) a base track;
(iv) an air cylinder for each of the clamping assemblies;
(v) a sewing arm;
(vi) an upper air cylinder assembly triangulated with lower air cylinder assemblies; and
(vii) a floating foot member attached to the upper air cylinder assembly.

7. The system according to claim 6 wherein the air cylinder is located beneath an upper head of the system and is centred directly along the centre line of a sewing arm.

8. The system according to claim 7 wherein the end of the air cylinder shaft is attached to and at the back of the floating foot.

9. The system according to claim 1 further comprising a X/Y-axis transporter bar and a channelled track to allow interchanging operation between:
i) triangulated lower clamping arm assemblies;
ii) tubular frame arm assemblies; and
iii) cap frame driver assembly.

10. The system according to claim 9 wherein the channelled track is replaced with a dedicated linear track fixed onto the X/Y axis transporter, with two linear bearing blocks which are easily positioned along the linear track and are adjustable by sprung locator pins.

11. The system according to claim 10 wherein the linear blocks allow for quick change of dedicated lower clamping block modules, including
i) triangulated lower clamping linear block module; and
ii) tubular frame arm linear block module.

12. The system according to claim 2 comprising at least 3 to 9 clamping assemblies.

13. The system according to claim 12 wherein the central over arm air cylinder assembly is configured with a floating foot member.

14. The system according to claim 13 further comprising a single or dual rod(s), and a lower base plate as part of an Air cylinder assembly wherein the height of the lower base plate and rod/s is positioned at an alternative height to enable the lower triangulated (dual) rods extending out of a connector, to hold the material at the same height as a needle plate.

* * * * *